US006144828A

United States Patent [19]

Sato

[11] Patent Number: 6,144,828

[45] Date of Patent: Nov. 7, 2000

[54] TONER RESERVOIR FOR USE IN ELECTROSTATIC IMAGE GENERATING APPARATUS

[75] Inventor: Tsutomu Sato, Tokyo, Japan

[73] Assignee: Asahi Kogaku Kogyo Kabushiki Kaisha, Tokyo, Japan

[21] Appl. No.: 09/420,506

[22] Filed: Oct. 19, 1999

[30] Foreign Application Priority Data

Oct. 20, 1998 [JP] Japan ..... 10-297822

[51] Int. Cl.[7] ..... G03G 15/08

[52] U.S. Cl. ..... 399/258; 141/364; 222/DIG. 1; 399/106

[58] Field of Search ..... 399/258, 106, 399/254, 255, 260, 262; 222/DIG. 1; 141/363, 364

[56] References Cited

U.S. PATENT DOCUMENTS

| | | | |
|---|---|---|---|
| 4,133,453 | 1/1979 | Ohbora | 222/DIG. 1 X |
| 4,583,843 | 4/1986 | Ohata et al. | 399/254 |
| 5,018,560 | 5/1991 | Tsukamoto | 141/364 |
| 5,260,749 | 11/1993 | Yahata | 399/106 |
| 5,742,877 | 4/1998 | Okada et al. | 399/106 |

FOREIGN PATENT DOCUMENTS 60-229071 11/1985 Japan .

*Primary Examiner*—Sophia S. Chen
*Attorney, Agent, or Firm*—Greenblum & Bernstein, P.L.C.

[57] ABSTRACT

A toner reservoir for a laser printer includes an elongated toner hopper housing extending in a horizontal direction and an elongated toner cartridge adapted for detachable attachment on the toner hopper housing with its bottom on the top of the latter. The toner hopper housing has an elongated top opening extending longitudinally of the toner hopper housing. The toner cartridge has an elongated bottom opening extending longitudinally of the toner cartridge. The top and bottom openings are adapted to mate with each other when the toner cartridge is attached on the toner hopper housing so as to allow discharge of toner through them from the toner cartridge into the toner hopper housing. The bottom opening is closed by a strip of sealing tape, which is removed away after the toner cartridge is attached on the toner hopper housing. A toner sensor is provided in the toner hopper housing. The toner hopper housing has upright partition walls dividing the space in the toner hopper housing into local regions arranged along the length thereof, such that any toner falling down from the toner cartridge into the toner hopper housing upon removal of the sealing tape is substantially prevented by the partition walls from moving from one of the local regions into another. In this manner, the toner level in the toner reservoir is effectively equalized along its length upon toner replenishment, allowing appropriate toner level detection by a single toner sensor.

12 Claims, 9 Drawing Sheets

TONER RESERVOIR FOR USE IN ELECTROSTATIC IMAGE GENERATING APPARATUS

The present disclosure relates to subject matter contained in Japanese Patent Application No. Hei-10-297822 filed on Oct. 20, 1998, which is expressly incorporated herein by reference in its entirety.

BACKGROUND OF THE INVENTION

1. Field of the Invention

The present invention relates to a toner reservoir for use in an electrostatic image generating apparatus.

2. Description of the Related Art

There are used various electrostatic image generating apparatus, including electrostatic copiers, laser printers, laser facsimile machines and the like. A typical electrostatic image generating apparatus uses a photosensitized medium, in the form of a drum or a belt, having a photosensitized surface made of photoconductive insulating material. A charging unit is used to place a uniform electrostatic charge over the photosensitized surface preparatory to imaging. Then, a desired light image is either projected by an optical system or drawn by a laser beam scanner on the photosensitized surface, to form an electrostatic latent image on the surface. Thereafter, the latent image is developed with a developing material, powdery material referred to in the art as toner, to form a powder image on that surface. The powder image is then transferred to and fixed onto a support surface, such as a surface of a sheet of paper.

For developing the latent image, such electrostatic image generating apparatus include a developer unit, which is designed to apply toner to the photosensitized surface having a latent image formed thereon, and a toner dispenser for dispensing toner into the developer unit. A typical toner dispenser comprises a dispenser roller cooperating with a toner reservoir, which may be also referred to as a toner hopper. The dispenser roller may comprise a foam roller, for example. During development process, toner is either continuously or periodically dispensed from the toner reservoir into the developer unit by means of the dispenser roller.

The toner reservoir reserves a supply of toner therein. After use of the apparatus for a certain length of time, such as several weeks or months, the supply of toner in the toner reservoir is depleted, so that the toner level in the toner reservoir reduces to reach a predetermined minimum level, above which the toner level has to be kept in order to ensure quality of images produced by the apparatus.

Many toner reservoirs used in recent electrostatic image generating apparatus are provided with a toner level sensor for sensing the toner level in the toner reservoir, so as to produce a low-toner-level alarm when it detects the toner level in the toner reservoir below the minimum level. This alarm is typically a visual alarm which may be provided by an indicator lamp, a visual display or the like. The user is informed thereby of the necessity for toner replenishment in the toner reservoir. In order to allow the user to conduct toner replenishment operation in a quick and clean manner, toner cartridges are widely used. Typically, a toner cartridge is filed with an amount of toner to be replenished in the toner reservoir and has a toner discharge opening closed with a strip of sealing tape which is removed away upon toner replenishment.

Recently, for compactness in structure, there are widely used toner reservoirs comprising an elongated container so disposed as to extend horizontally along the associated dispenser roller. Such a toner reservoir is highly advantageous for compactness; however, the toner level in such horizontally-elongated toner reservoir tends to have relatively large variation along the length of the toner reservoir. In addition, use of a toner cartridge may often add to difficulty in achieving equalized toner distribution along the length of the toner reservoir upon toner replenishment.

Relatively large variation in the toner level along the length of the toner reservoir causes local depletion of toner in the toner reservoir, which in turn either necessitates frequent toner replenishment if the toner cartridge has a limited capacity or requires a large space to be occupied by the toner reservoir if it has a sufficient capacity. Further, relatively large variation in the toner level along the length of the toner reservoir may make it impossible to ensure appropriate toner level detection by a single toner level sensor.

SUMMARY OF THE INVENTION

In view of the foregoing, it is an object of the present invention to provide a toner reservoir for use in an electrostatic image generating apparatus, wherein the toner reservoir comprises a horizontally-extending, elongated container which is advantageous for compactness, while the toner level in the elongated toner reservoir can be highly equalized along its length.

In accordance with the present invention, there is provided a toner reservoir for use in an electrostatic image generating apparatus, comprising an elongated toner hopper housing extending in a horizontal direction and defining a space for reserving toner therein. The toner hopper housing has an elongated top opening extending longitudinally of the toner hopper housing. The toner reservoir further comprises an elongated-toner cartridge having an amount of toner filled therein and adapted for detachable attachment on the toner hopper housing with the bottom thereof on the top of the toner hopper housing. The toner cartridge has an elongated bottom opening extending longitudinally of the toner cartridge. The top opening of the toner hopper housing and the bottom opening of the toner cartridge are adapted to mate with each other when the toner cartridge is attached on the toner hopper housing so as to allow discharge of toner therethrough from the toner cartridge into the toner hopper housing. The toner cartridge has a strip of sealing tape closing the bottom opening, the sealing tape being adapted to be removed away to open the bottom opening after the toner cartridge is attached on the toner hopper housing. The toner hopper housing has one or more partition walls so formed as to divide the space in the toner hopper housing into two or more local regions arranged along the length of the toner hopper housing, such that any toner falling down from the toner cartridge into the toner hopper housing upon removal of the sealing tape is substantially prevented from moving from one of the local regions into another.

The sealing tape may be preferably adapted to be removed away along the length of the bottom opening from one longitudinal end of the bottom opening to the other longitudinal end of the bottom opening.

The one or more partition walls each may preferably comprise a flat vertical wall extending in a vertical plane substantially perpendicular to the longitudinal direction of the toner hopper housing.

Further, the one or more partition walls each may preferably comprise a flat vertical wall having a top edge thereof facing to and lying adjacent the under surface of the sealing tape after the toner cartridge is attached on the toner hopper housing and before the sealing tape is removed away.

It may be preferable that the toner reservoir further comprises a dispenser roller, having an effective length, for dispensing toner from the toner reservoir and housed in the toner hopper housing, and the top opening of the toner hopper housing extends along and just above the dispenser roller so as to substantially cover the effective length of the dispenser roller.

It may be also preferable that the toner hopper housing has a double-bottom structure comprising an inner bottom wall and an outer bottom wall, the inner bottom wall is adapted to cooperate with the dispenser roller to control amount of toner to be dispensed from the toner reservoir, and the outer bottom wall has a toner dispensing slit through which toner is dispensed from the toner reservoir.

The toner reservoir may be preferably provided with a toner sensor disposed in the toner hopper housing above and adjacent the inner bottom wall.

BRIEF DESCRIPTION OF THE DRAWINGS

The above and other objects, features and advantages of the present invention will be apparent from the following detailed description of a preferred embodiment thereof, reference being made to the accompanying drawings, in which.

DETAILED DESCRIPTION OF A PREFERRED EMBODIMENT

Referring now to the accompanying drawings, a preferred embodiment of the present invention will be described in detail.

Figure 1:
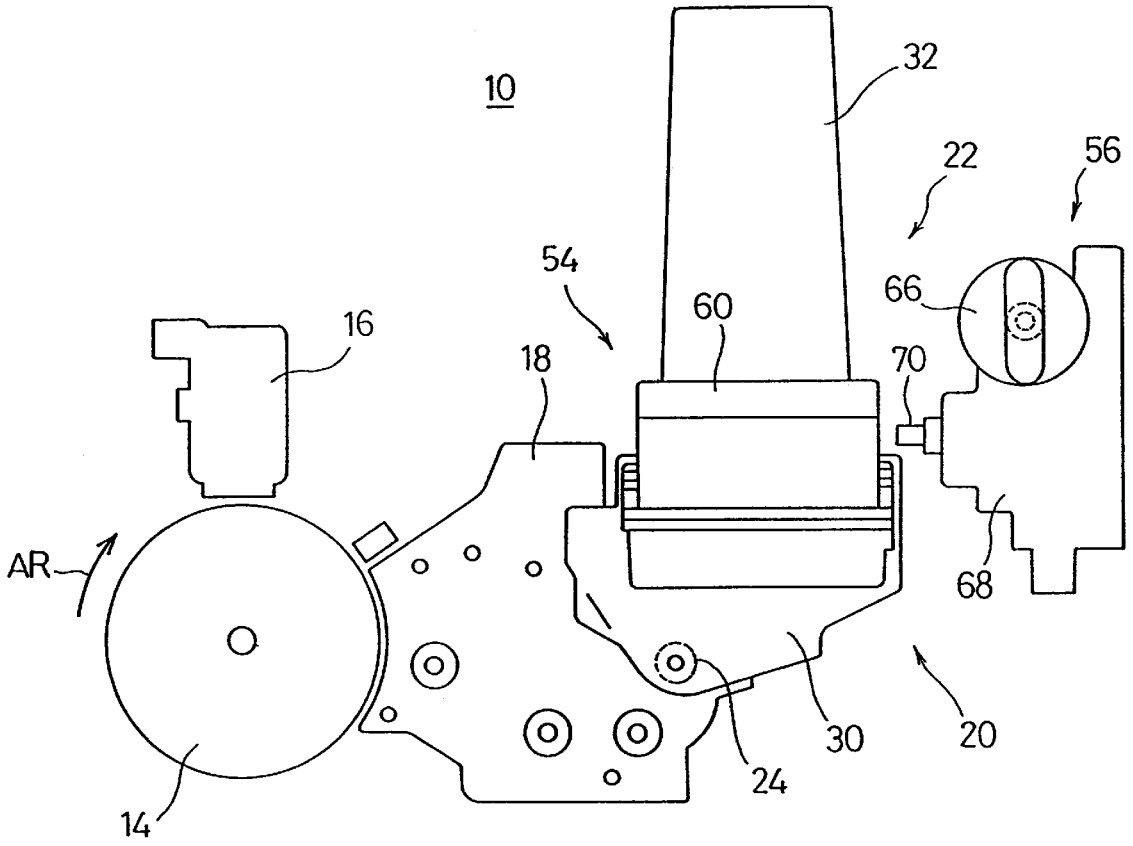
FIG. 1 is a schematic showing a relevant part of an electrostatic image generating apparatus using a toner reservoir, comprising a toner cartridge and a toner hopper housing, according to a preferred embodiment of the present invention.

FIG. 1 shows a relevant part of an electrostatic image generating apparatus using a toner reservoir according to a preferred embodiment of the present invention. The apparatus, generally designated by reference numeral 10, comprises a laser printer. Among various elements and components of the laser printer 10, FIG. 1 only shows those which provide the functions related to the development process of electrostatic latent images, while the other elements and components, which may be any conventional ones, are omitted for simplicity. In particular, the laser printer 10 has a photosensitized drum 14, the outer periphery of which is coated with a suitable photoconductive material. The drum 14 is suitably journaled for rotation within a machine frame (not shown) by means of a shaft and is rotated in the direction indicated by arrow AR by means of a suitable drive mechanism (not shown). The laser printer 10 further comprises a charging unit 16 for placing a uniform electrostatic charge over the photoconductive surface of the drum 14 preparatory to imaging.

Onto the charged photoconductive surface, a desired image (which may be a text image or a picture image) is drawn by means of an image drawing unit (not shown) utilizing a laser beam scanner for projecting a laser beam to be focused on the surface. Any regions exposed to the laser beam have the charge dissipated, so that an electrostatic latent image is created on the drum surface.

The laser printer 10 further comprises a developer unit 18 and a toner dispenser unit 20. The developer unit 18 serves to develop the electrostatic latent image with a developing material, powdery material referred to in the art as toner, so as to form a powder image corresponding to the latent-image. The developer unit 18 comprises a toner applicator for applying toner to the charged regions of the drum surface to render the latent image visible. The toner applicator may be any conventional means for providing the required function. For example, it may comprise any kind of magnetic brushes known in the art.

The toner dispenser unit 20 comprises a toner reservoir 22 for reserving a supply of toner therein and a dispenser roller 24 for dispensing toner from the toner reservoir 22 into the developer unit 18 during development process. The dispenser roller 24 is housed within the toner reservoir 22 and disposed near the bottom of the toner reservoir 22. The dispenser roller 24 comprises a shaft and a cylindrical member made of a foam material and fitted over the shaft. The dispenser roller 24 is journaled for rotation about its axis and so disposed as to extend in a horizontal direction parallel to the photosensitized drum 14 of the developer unit 18. The dispenser roller 24 has its effective length substantially equal to the effective length of the photosensitized drum 14.

The toner reservoir 22 comprises a horizontally-extending, elongated container consisting of upper and lower vessels separable from each other. The lower vessel comprises a toner hopper housing 30 elongated in shape and extending in a horizontal direction, while the upper vessel comprises a disposable toner cartridge 32 elongated in shape and adapted for detachable attachment on the toner hopper housing 30 with its bottom on the top of the toner hopper housing 30.

Briefly, the toner cartridge 32 is designed for quick attachment/detachment on/from the toner hopper housing 30. Before use, the toner cartridge 32 is filled with an amount of toner to be replenished in the toner reservoir 22. Once attached, the toner cartridge 32 is kept on the toner hopper housing 30 until a new toner cartridge is replaced for it. Accordingly, the toner hopper housing 30 and the toner cartridge 32 together form the container serving as the toner reservoir 22, within which the dispenser roller 24 is housed and the supply of toner is reserved. The toner hopper housing 30 has a double-bottom structure comprising an inner bottom wall 34 and an outer bottom wall 36, as described in more detail later.

Figure 2:
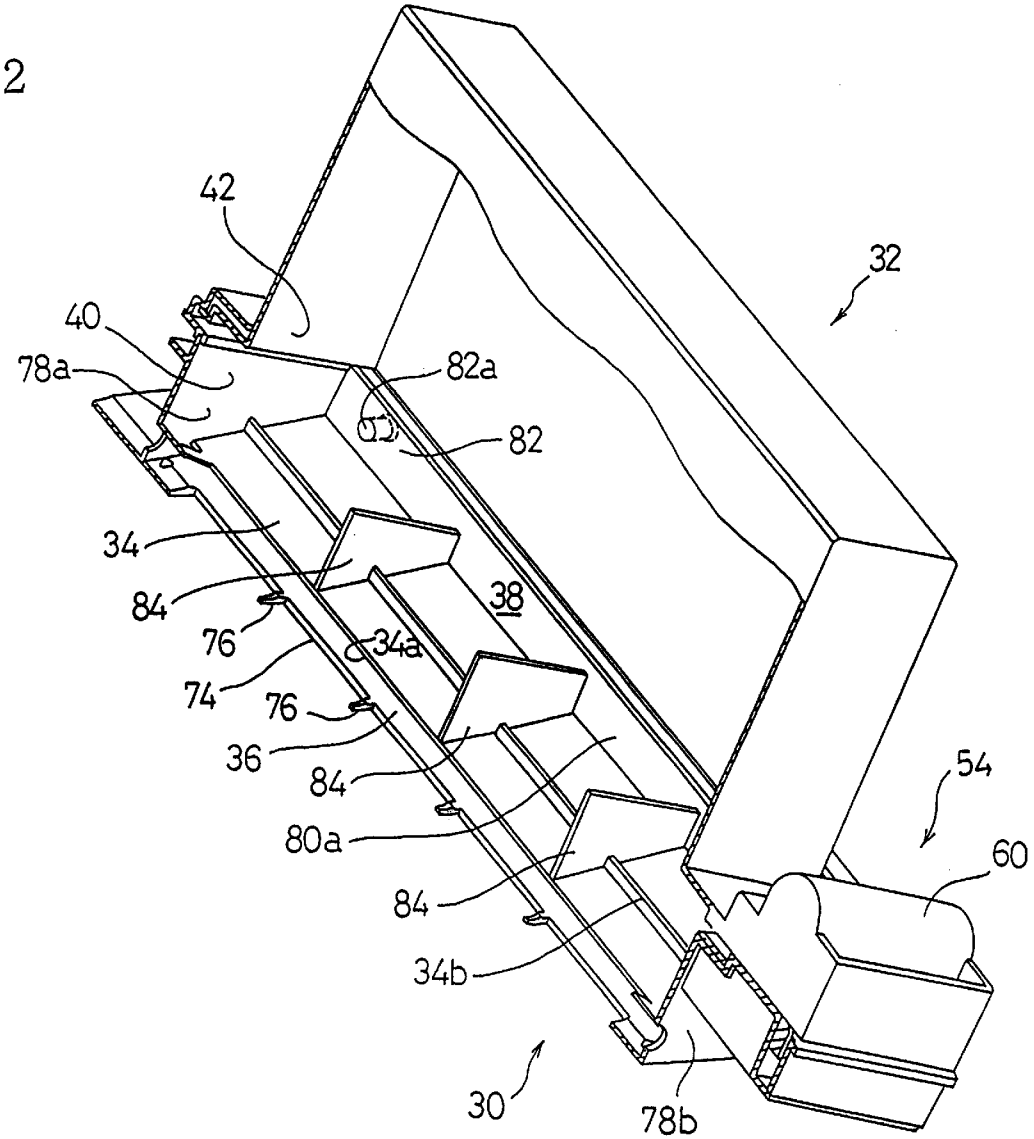
FIG. 2 is a perspective view of the toner cartridge attached on the toner hopper housing, partially cut away generally along a longitudinal vertical plane.
Figure 3:
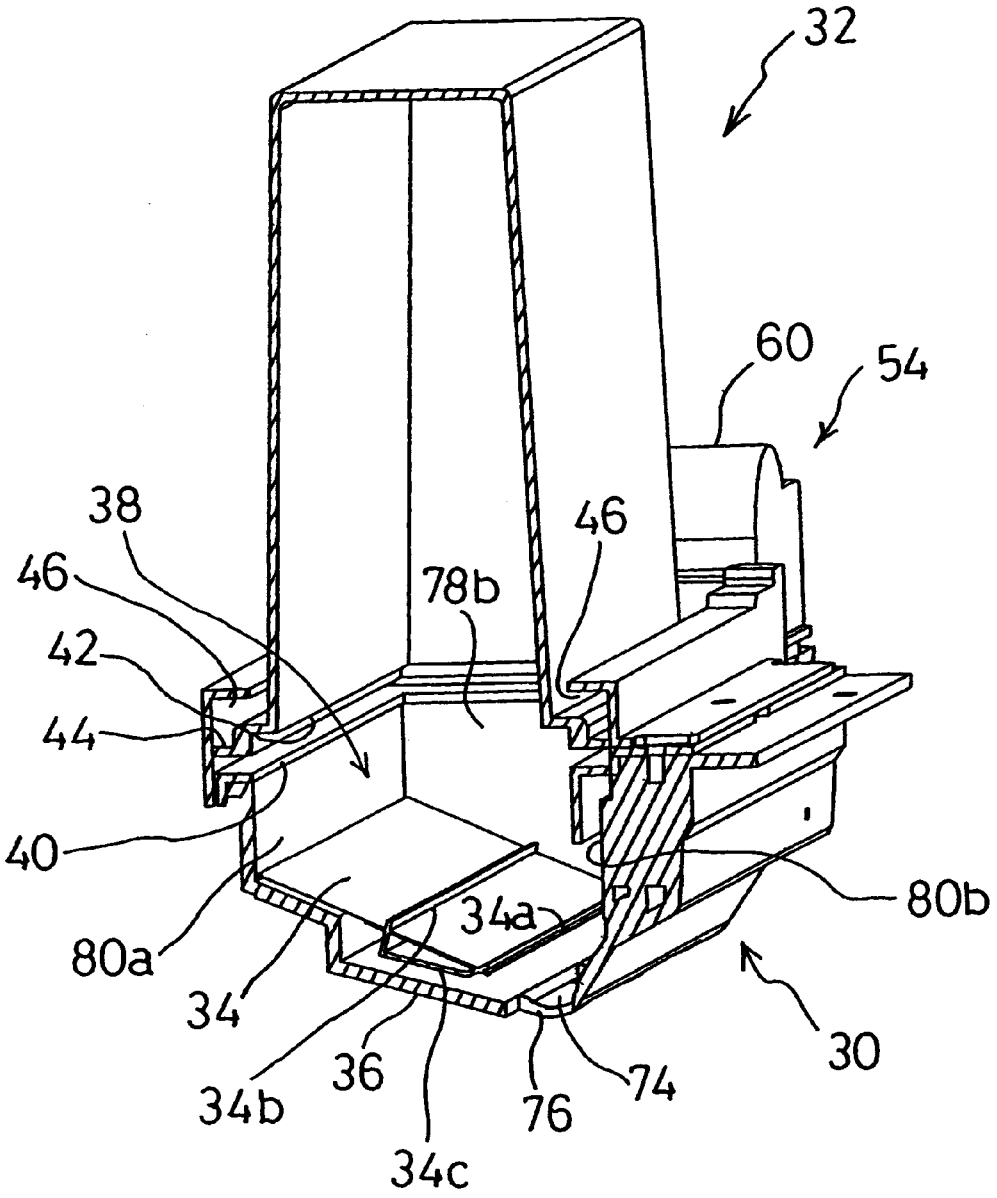
FIG. 3 is a perspective view of the toner cartridge attached on the toner hopper housing, partially cut away along a cross-cutting plane.

More specifically, as shown in FIGS. 2 and 3, the toner hopper housing 30 is a horizontally-extending, elongated vessel having its top substantially fully open. Accordingly, the toner hopper housing 30 defines a space 38 for reserving toner therein and has an elongated top opening 40. The top opening 40 is generally rectangular in shape and extends longitudinally of the toner hopper housing 30. The top opening 40 extends along and just above the dispenser roller 24 so as to substantially cover the effective length of the dispenser roller 24.

The toner cartridge 32 has a casing, which is an elongated, box-shaped vessel having its bottom substantially fully open. Thus, the toner cartridge 32 has an elongated bottom opening 42, which is generally rectangular in shape and extends longitudinally of the toner cartridge 32.

The top opening 40 of the toner hopper housing 30 and the bottom opening 42 of the toner cartridge 32 are similar to each other in shape and size, and are adapted to mate with each other when the toner cartridge 32 is attached on the toner hopper housing 30, so as to allow discharge of toner therethrough from the toner cartridge 32 into the toner hopper housing 30.

Figure 4:
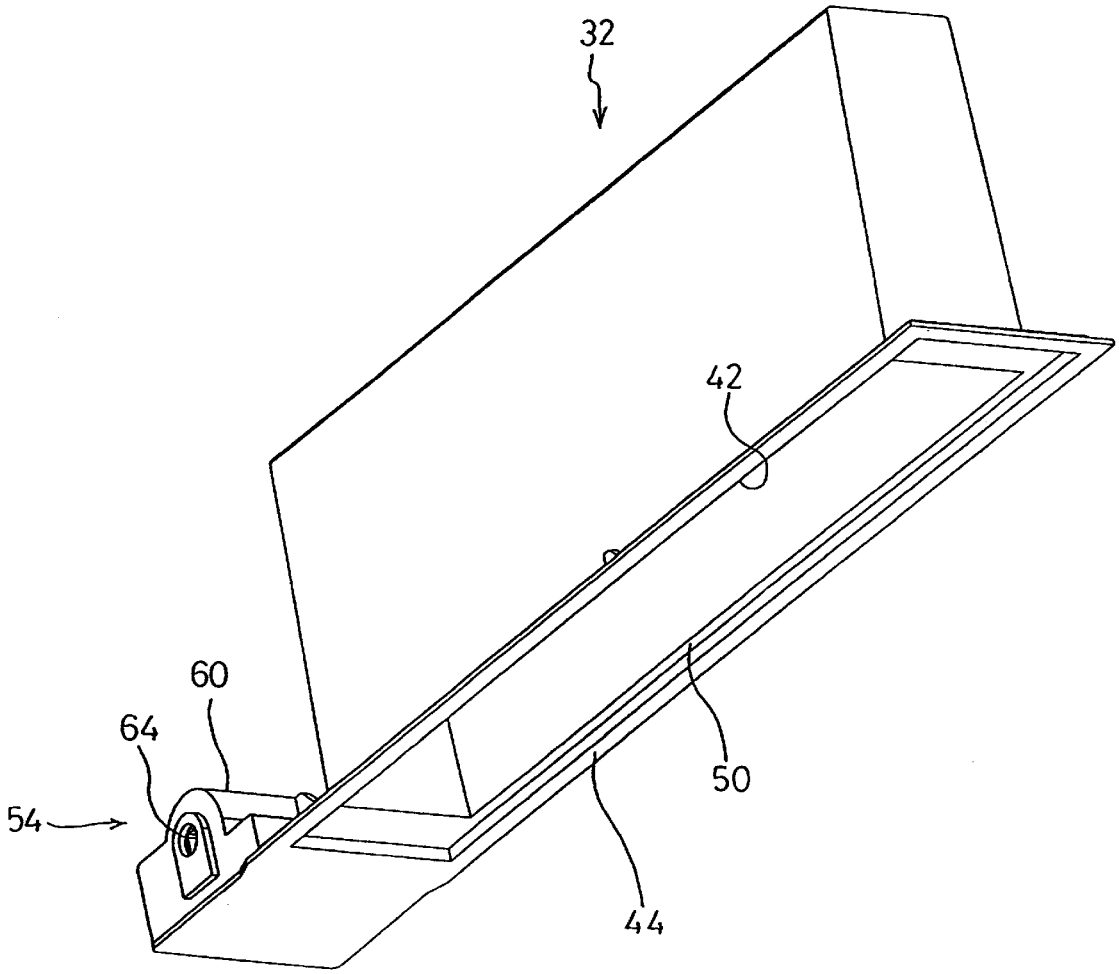
FIG. 4 is a perspective view of an empty casing of the toner cartridge after removal of a strip of sealing tape.

As best seen from FIG. 4, the casing of the toner cartridge 32 has a bottom flange plate 44 extending outwardly from the edges of the bottom opening 42. The bottom flange plate 44 has a rectangular outline with a pair of end edges and a pair of side edges. In correspondence thereto, the top opening 40 of the toner hopper housing 30 has four edges including a pair of end edges and a pair of side edges, among which one end edge and the pair of side edges are provided with respective receptacle slots 46 for receiving the corresponding edges of the bottom flange plate 44 of the toner cartridge 32.

With this structure, the opposite side edges of the bottom flange plate 44 of the toner cartridge 32 can be slid into the corresponding receptacle slots 46 provided on the opposite side edges of the toner hopper housing 30. With the front end edge of the bottom flange plate 44 of the toner cartridge 32 being received in the corresponding end receptacle slot 46 of the toner hopper housing 30, the toner cartridge 32 is positioned relative to the toner hopper housing 30 and retained there by means of suitable click stops (not shown) provided between them. By virtue of this, the attachment/detachment of the toner cartridge 32 on/from the toner hopper housing 30 may be accomplished in a quick manner.

As shown in FIG. 4, the bottom flange plate 44 of the toner cartridge 32 has a retracted surface 50 (retracted from the bottom surface of the toner cartridge 32) defining the peripheral area of the bottom opening 42. The retracted surface 50 provides a sealing surface. After a measured amount of toner is filled in the toner cartridge 32, a strip of flexible, removable, sealing tape 52 (schematically shown in FIGS. 6A, 6B, 6D and 6E) is adhered to the sealing surface 50 so as to sealingly close the bottom opening 42 of the toner cartridge 32. The sealing tape 52 is made of a suitable plastic film material which can be strippably adhered onto any smooth surface by heating. The sealing tape 52 is adapted to be removed away to open the bottom opening 42 after the toner cartridge 32 is attached on the toner hopper housing 30.

Figure 6A:
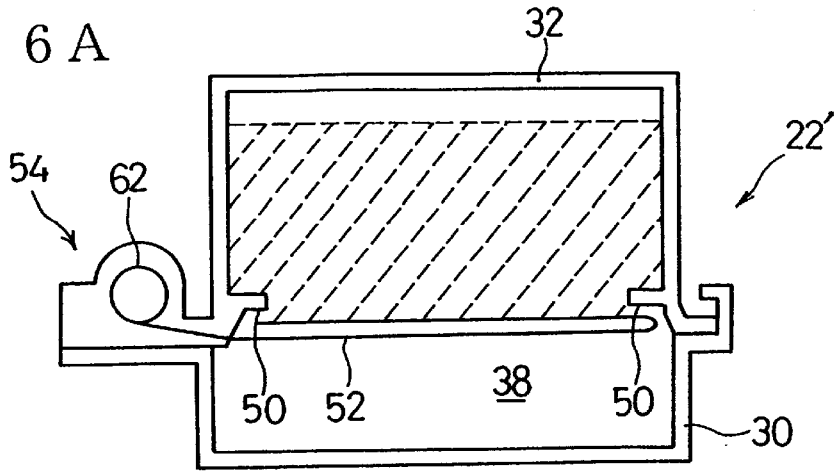
FIGS. 6A through 6F are schematics illustrating the function of partition walls provided in the toner hopper housing.

For facilitating removal of the sealing tape 52, i.e., stripping it from the sealing surface 50, the toner cartridge 32 has a tape take-up reel mechanism 54 provided on the bottom flange plate 44 and at one end of the toner cartridge 32. For convenience, this end of the toner cartridge 32 is referred to hereinafter as the "second end", while the other end of the toner cartridge 32 as the "first end". Before removal, as shown in FIG. 6A, the strip of sealing tape 52 has its one end terminating at the end edge of the bottom opening 42 at the second end of the toner cartridge 32 (referred to as the "second end edge of the bottom opening 42".) The sealing tape 52 extends therefrom toward the opposite end edge of the bottom opening 42 at the first end of the toner cartridge 32 (referred to as the "first end edge of the bottom opening 42"), and thence, turns around to return toward the second end of the toner cartridge 32 and enter the tape take-up reel mechanism 54 through a slit formed in the bottom flange plate 44.

Here, the portion of the strip of sealing tape 52 that extends from the second end edge to the first end edge of the bottom opening 42 is referred to as the first portion of the sealing tape 52, while the following portion that returns from the first end edge of the bottom opening 42 to the tape take-up reel mechanism 54 as the second portion of the sealing tape 52. Only the first portion of the sealing tape 52 is adhered by heating to the sealing surface 50 of the toner cartridge 32, while the second portion is not adhered to the sealing surface 50 at all. The second portion is just utilized to strip the first portion of the sealing tape 52 off the sealing surface 50 by means of the sealing tape take-up reel mechanism 54.

The laser printer 10 is provided with a sealing tape remover handle mechanism 56 (shown in FIGS. 1 and 5) for driving the sealing tape take-up reel mechanism 54 of the toner cartridge 32. The sealing tape take-up reel mechanism 54 includes a reel housing 60 and a tape take-up reel 62 housed therein. The reel housing 60 is formed as an integral part of the casing of the toner cartridge 32. The reel 62 is supported by the reel housing 60 and has a rectangular socket hole 64 formed in one end surface thereof. The socket hole 64 is exposed through an opening formed in the reel housing 60 so as to be accessible to the sealing tape remover handle mechanism 56.

Figure 5:
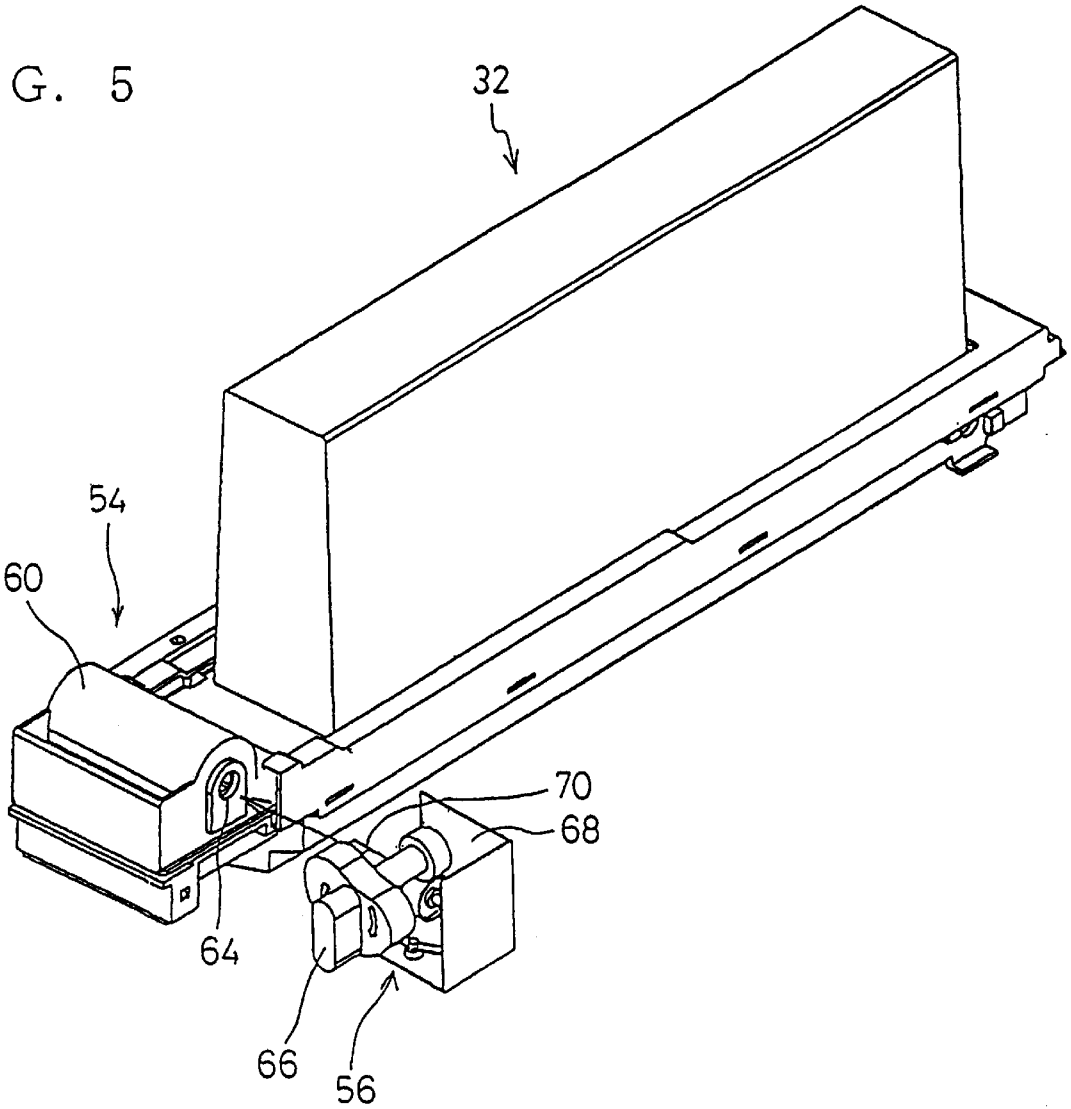
FIG. 5 is a perspective view of the toner cartridge attached on the toner hopper housing together with a tape remover handle mechanism.

As shown in FIGS. 1 and 5, the handle mechanism 56 comprises a rotary handle 66 and a connection mechanism 68 for operatively connecting the rotary handle 66 to the reel 62 of the sealing tape take-up reel mechanism 54. The connection mechanism 68 includes a drive shaft 70, which is operatively connected to and rotated by the rotary handle 66. Also, the drive shaft 70 is capable of longitudinal movement between protruded and retracted positions. The drive shaft 70 has its tip end formed in a shape for fitting into the rectangular socket hole 64 of the reel 62. This fitting connection between the drive shaft 70 and the reel 62 occurs when the former is in its protruded position, so as to allow torque transmission between them.

Upon replacement of the toner cartridge 32 with a new one, the drive shaft 70 is moved into the retracted position by a linkage (not shown). After installation of the new toner cartridge on the toner hopper housing 30, the drive shaft 70 is moved by the linkage to the protruded position and the tip end thereof is fitted into the socket hole 64 of the reel 62. Then, the user can rotate the rotary handle 66 to strip the sealing tape 52 off the sealing surface 50 to open the bottom opening 42, so that the amount of toner in the toner cartridge 32 is allowed to fall down into the toner hopper housing 30 to complete toner replenishment in the toner reservoir 22. Accordingly, when toner is replenished in the toner reservoir 22, the sealing tape 52 is removed away along the length of the elongated bottom opening 42, i.e., from one longitudinal end of the bottom opening 42 to the other longitudinal end of the bottom opening 42.

The toner hopper housing 30 will be described in more detail hereinafter. The toner hopper housing 30 has a pair of end walls 78*a* and 78*b* (FIG. 2) and a pair of side walls 80*a* and 80*b* (FIG. 3). In addition, as described above, the toner hopper housing 30 has the double-bottom structure comprising the inner bottom wall 34 and the outer bottom wall 36.

The outer bottom wall 36 is formed as an integral part of the toner hopper housing 30 itself. The outer bottom wall 36 has a toner dispensing slit 74 formed therein, which extends along and just under the dispenser roller 24 to cover the entire length of the dispenser roller 24, so that any toner falling down off the surface of the dispenser roller 24 may pass through the slit 74 to exit the toner hopper housing 30 into the developer unit 18. The toner hopper housing 30 also has a plurality of bridges 76 connecting opposite edges of the slit 74 for reinforcement of the toner hopper housing 30.

Figure 7:
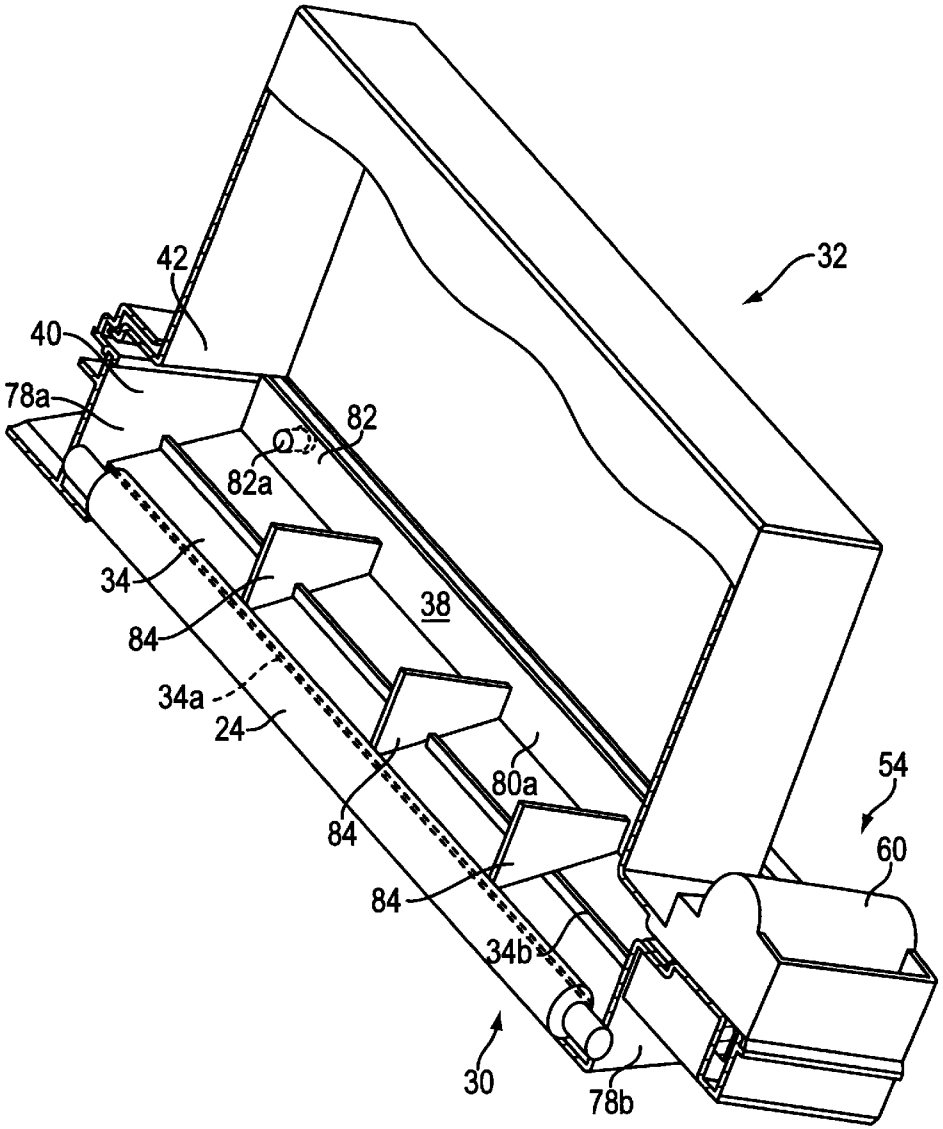
FIG. 7 is a perspective view similar to FIG. 2, but showing a dispenser roller in place.

The inner bottom wall 34 comprises a flat, thin, generally rectangular plate extending between the end walls 78*a* and 78*b* and slanting down with a shallow slant from one of the side walls, 80*a*, of the toner hopper housing 30 toward the dispenser roller 24 to terminate at a lip edge 34*a*. The lip edge 34*a* of the inner bottom wall 34 extends along and covers the entire length of the dispenser roller 24, and is kept in engagement with the cylindrical surface of the dispenser roller 24, as shown in FIG. 7.

The inner bottom wall 34 has a longitudinal stiffener rib 34*b*, as well as a lip reinforcement strip 34*c* (FIG. 3) extending along the lip edge 34*a*. The lip reinforcement strip 34*c* prevents any substantial deformation of the lip edge 34*a*, which otherwise could be caused by the force acting from the dispenser roller 24 to the lip edge 34*a*. The inner bottom wall 34 may be vibrated by means of a suitable vibrator unit (not shown) in order to convey any toner thereon down toward the dispenser roller 24.

With the structure described above, the outer bottom wall 36 extends below the inner bottom wall 34 to provide protection for the inner bottom wall 34 and the dispenser roller 24, while the combination of the inner bottom wall 34 and the dispenser roller 24 provides the essential function of the bottom, i.e., the combination serves to retain the supply of toner in the toner reservoir 22 by preventing it from freely flowing down out of the toner reservoir 22. By cooperation of the inner bottom wall 34 with the dispenser roller 24, only a controlled dose of toner per unit of time, which depends on the rotational speed of the dispenser roller 24, is caused to pass through the area of engagement between the dispenser roller 24 and the lip edge 34*a* of the inner bottom wall 34 and fall down through the toner dispensing slit 74 formed in the outer bottom wall 36 into the developer unit 18. This manner of dispensing toner is based on the adhesive nature of toner to the foam material of the dispenser roller 24, as is well known in the art.

The toner reservoir 22 is provided with a toner sensor 82 disposed in the toner hopper housing 30 above and adjacent the inner bottom wall 34. The toner sensor 82 is used to detect and indicate to the user when the toner level in the toner reservoir 22 has reduced to reach a predetermined minimum level, above which the toner level has to be kept in order to ensure quality of images produced by the laser printer 10. The toner sensor 82 has a sensitive surface 82*a* exposed to and disposed in the space 38 defined in the hopper housing 30 and is capable of detecting whether the sensitive surface 82*a* is in contact with the amount of toner reserved in the toner reservoir 22. If so, the toner level in the toner reservoir is above the minimum level. Otherwise, it is below the minimum level so that toner replenishment is required.

The space 38 inside the toner hopper housing 30 is elongated in shape and has a cross-section which is substantially uniform along the entire length of the space 38. This cross-section is delimited by the opposite side walls 80*a* and 80*b* of the toner hopper housing 30, the inner bottom wall 34 of the toner hopper housing 30 and the horizontal plane in which the sealing tape 52 of the toner cartridge 32 extends. The toner hopper housing 30 has three identical, upright partition walls 84, each extending perpendicular to the longitudinal axis of the elongated toner hopper housing 30. The three partition walls 84 are so formed as to divide the space 38 in the toner hopper housing 30 into four local regions arranged along the length of the toner hopper housing 30.

Each partition wall 84 substantially separates two adjacent local regions in the toner hopper housing 30 from each other, such that any toner falling down from the toner cartridge 32 into the toner hopper housing 30 upon removal of the sealing tape 52 is substantially prevented from moving from one of the local regions into another.

Specifically, each partition wall 84 is a flat, vertical wall extending in a vertical plane which is substantially perpendicular to the longitudinal axis of the space 38 in the toner hopper housing 30, and thus to the longitudinal direction of the toner hopper housing 30. Also, each partition wall 84 has an outline generally corresponding to the cross-section of the space 38. More specifically, each partition wall 84 has a pair of side edges, a bottom edge and a top edge. One of the side edges of the partition wall 84 is connected to one of the side walls, 80*a*, of the toner hopper housing 30, while the other of the side edges faces to the other of the side walls, 80*b*, with a small gap left between them. The bottom edge of partition wall 84 faces to the inner bottom wall 34 with a small gap left between them. The top edge of partition wall 84 extends horizontally, such that it faces to and lies adjacent the under surface of the sealing-tape 52 of the toner cartridge 32 after the toner cartridge 32 is attached on the toner hopper housing 30 and before the sealing tape 52 is removed away.

Figure 8:
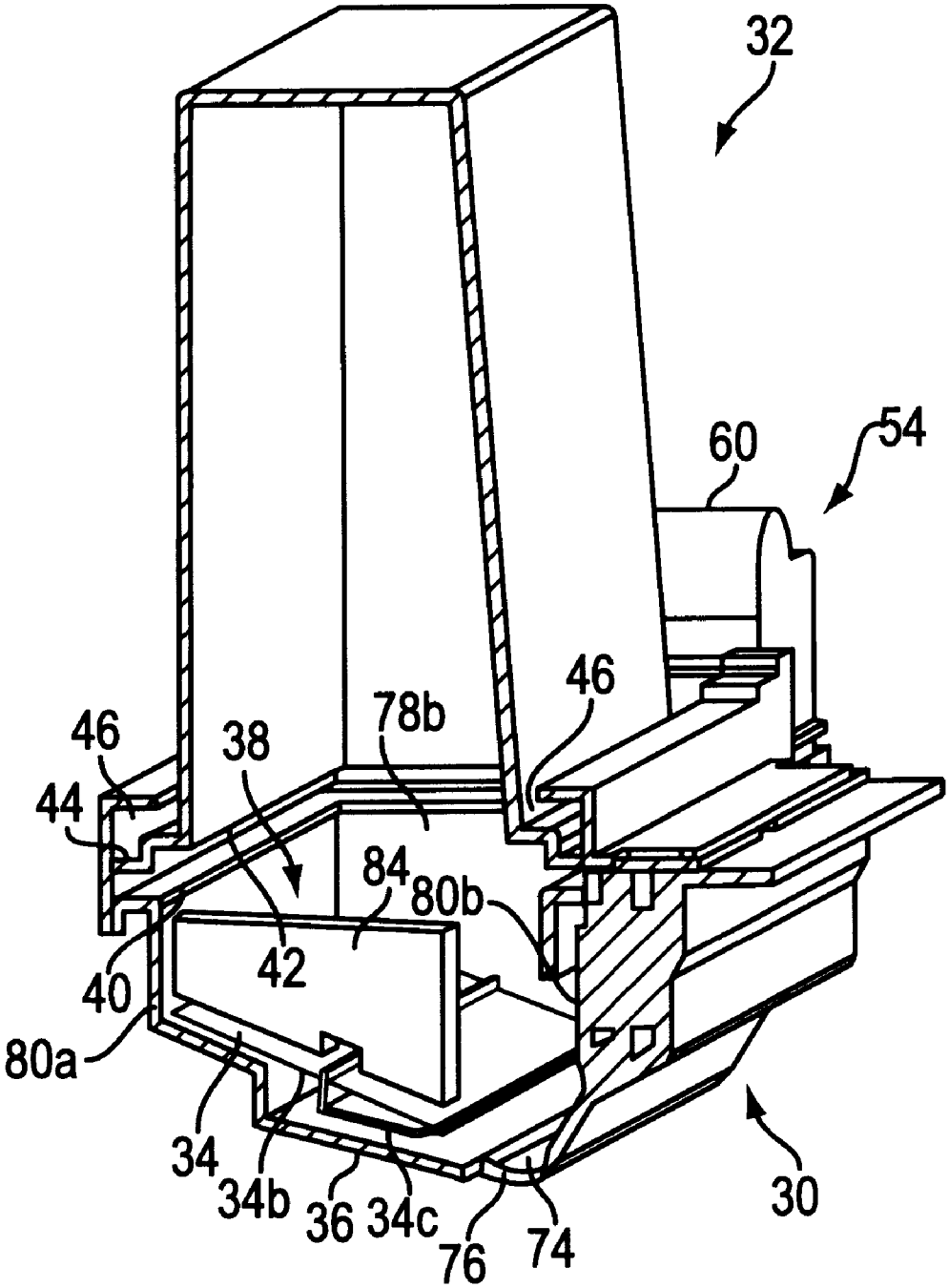
FIG. 8 is a perspective view similar to FIG. 3, but showing a partition wall and gap between the partition wall and inner bottom wall.

Accordingly, each partition wall 84 is supported only at one of the side edges thereof by the one of the side walls of the toner hopper housing 30, i.e., supported in cantilevered manner, as shown in FIG. 8. The bottom edge of the partition wall 84 has a small cutout, through which the reinforcement rib 34*b* of the inner bottom wall 34 extends. This cutout, together with the gap left between the bottom edge of the partition wall 84 and the inner bottom wall 34, as shown in FIG. 8, makes the partition wall 84 and the inner bottom wall 34 completely contactless with each other, which serves to avoid interference to the vibration of the inner bottom wall 34.

Figure 6B:
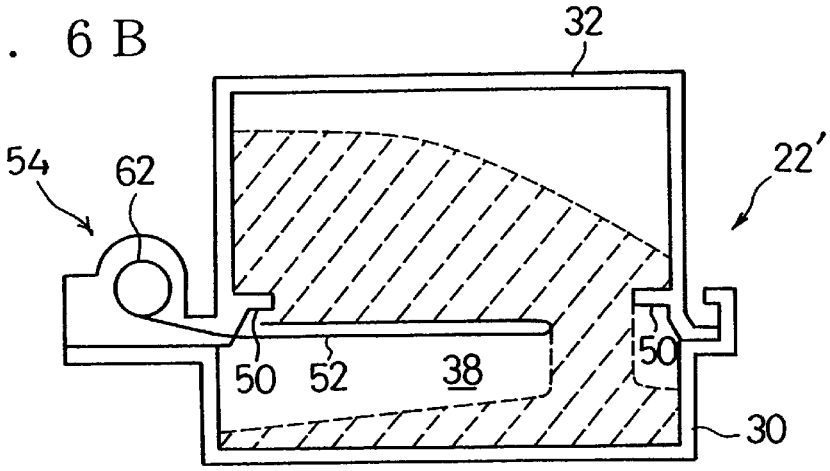
Figure 6C:
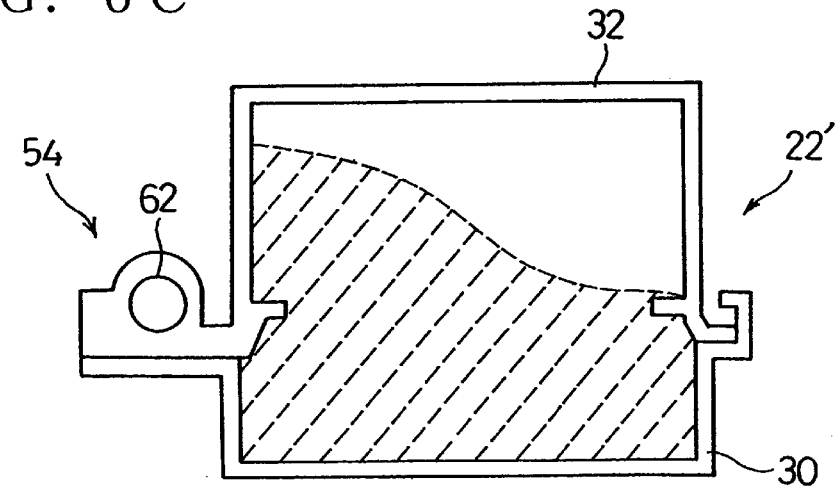
Figure 6D:
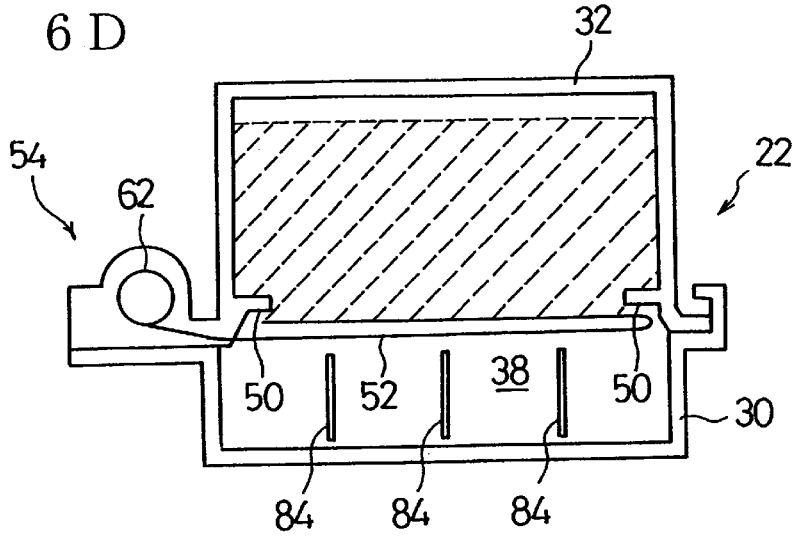
Figure 6E:
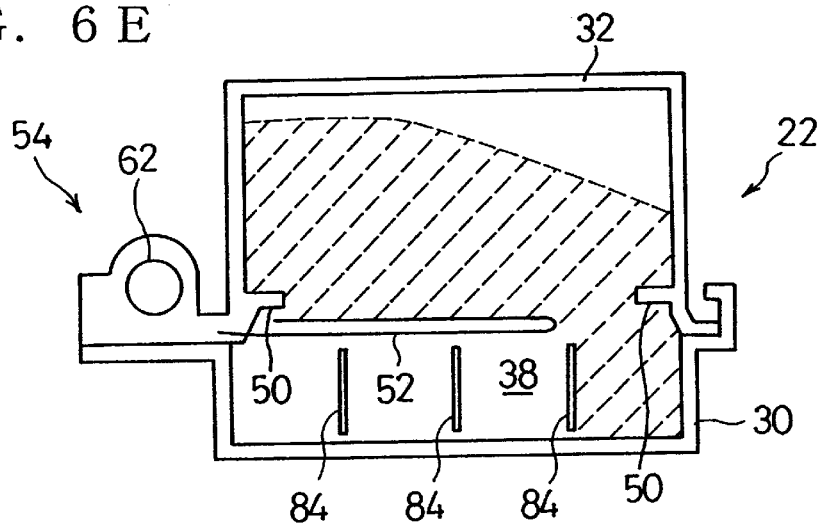
Figure 6F:
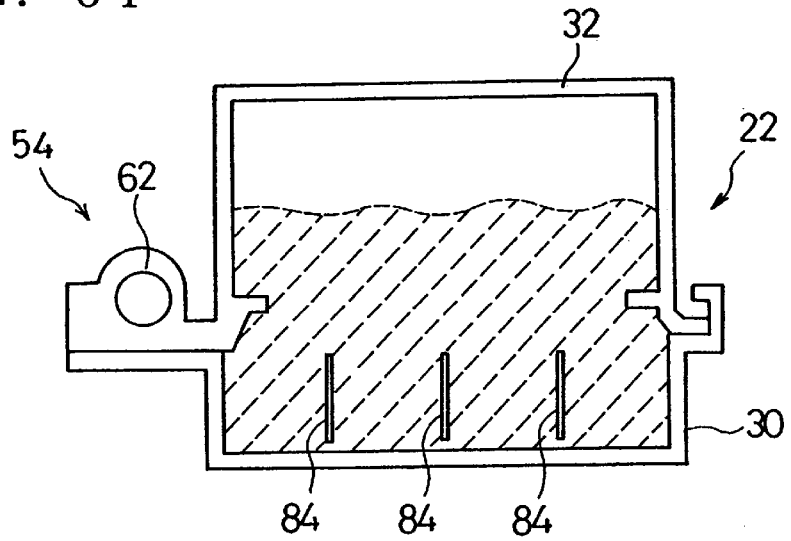

FIGS. 6A, 6B, 6C, 6D, 6E and 6F illustrate the advantageous effects of the partition walls 84. FIGS. 6A to 6C show a toner reservoir 22' which is identical in structure to the above-described toner reservoir 22 except for elimination of partition walls 84. Like components are designated by like reference numerals between FIGS. 6A to 6C and FIGS. 1 to 5. FIGS. 6D to 6F show the toner reservoir 22 having the partition walls 84, just as described above.

FIGS. 6A and 6D show the toner reservoirs 22' and 22 before removal of the sealing tape 52 of the toner cartridge 32. It is seen that the toner level in the toner cartridge 32 is substantially equalized.

FIGS. 6B and 6E show the toner reservoirs 22' and 22 with the sealing tape 52 being partially peeled off. Of the amount of toner in the toner cartridge 32, the part at the first end of the toner cartridge 32 is freely falling down into the space 38 in the toner hopper housing 30. Due to the free fall, the part of the amount of toner has gained an increased fluidity or flowability, so that it flows highly smooth. As the result, the falling toner down into the space 38 in the toner hopper housing 30 will flow longitudinally of the space 38 if no partition wall is provided, as shown in FIG. 6B. In contrast, with the toner reservoir 22 of FIG. 6E, any falling toner down into the space 38 will be confined in the local region of the space 38 into which it has fallen, so that the partition walls 84 substantially prevent toner from flowing longitudinally in the space 38.

FIGS. 6C and 6F show the toner reservoirs 22' and 22 with the sealing tape 52 completely removed away. As seen from FIG. 6C, in the toner reservoir 22' with no partition wall, there is left relatively large variation in the toner level along the length of the toner reservoir 22', which is created by the longitudinal flow of toner in the space 38 as described above. This relatively large variation is characterized by a considerably low toner level at the end of the toner reservoir 22' from which peeling of the sealing tape 54 starts, and a considerably high toner level at the opposite end of the toner reservoir 22'.

In contrast, as seen from FIG. 6F, in the toner reservoir 22 having the partition walls 84 dividing the space 38 into local regions arranged along the length thereof, there is left only relatively small variation in the toner level along the length of the toner reservoir 22. This relatively small variation is characterized by repeating higher and lower toner levels corresponding to the periodicity of the partition walls. FIG. 6F clearly shows that the toner level is substantially equalized throughout the length of the toner reservoir 22 at the time when toner replenishment is completed.

In addition, by virtue of the structure of the toner reservoir 22 described above, any reduction in the toner level caused by dispensing of toner out of the toner reservoir 22 will be substantially uniform throughout the length of the toner reservoir 22. Thus, the substantially equalized toner level with only small variation as achieved upon toner replenishment will last until the supply of toner in the toner reservoir 22 is so depleted that the toner level therein reduces to reach the minimum level. Therefore, the toner reservoir 22 is free from any inconveniences which otherwise could arise from large variation in the toner level along the length of the toner reservoir 22, including impossibility of achieving appropriate toner level detection by a single toner level sensor disposed in the toner reservoir.

The embodiment shown and described includes three partition walls 84 provided in the toner hopper housing 30; however, less or more partition walls may be used if appropriate. Further, the partition walls 84 may be formed in various other forms. For example, the partition walls 84 may be modified such that each partition wall has a bottom edge connected to the outer bottom wall of the toner hopper housing 30, with a suitable modification to the inner bottom wall 34 such that it comprises a plurality of separate wall portions each corresponding to one of the local regions delimited by the partition walls. Alternatively, the partition walls 84 may be modified such that each partition wall has a bottom edge connected to the inner bottom wall 34. In such case, the stiffener rib 34*b* may be eliminated because the partition walls may serve as stiffener ribs.

The present invention may be applied to various toner reservoirs comprising a toner hopper housing and a toner cartridge for toner replenishment, in which the toner cartridge has a strip of sealing tape to be removed away after the toner cartridge is attached on the toner hopper housing. The manner of removing the sealing tape may be any of conventional ones. For example, the user may pull one end of the sealing tape by his/her hand to remove away it, or a suitable motor-driven mechanism may be used for the purpose.

Having described the present invention with reference to the preferred embodiment thereof, it is to be understood that the present invention is not limited to the disclosed embodiment, but may be embodied in various other forms without departing from the spirit and the scope of the present invention as defined by the appended claims.

What is claimed is:

1. A toner reservoir for use in an electrostatic image generating apparatus, comprising:

an elongated toner hopper housing extending in a horizontal direction and defining a space for reserving toner therein, said toner hopper housing having an elongated top opening extending in a longitudinal direction of said toner hopper housing;

an elongated toner cartridge having an amount of toner filled therein and adapted for detachable attachment on said toner hopper housing with the bottom thereof on the top of said toner hopper housing, said toner cartridge having an elongated bottom opening extending in a longitudinal direction of said toner cartridge;

said top opening of said toner hopper housing and said bottom opening of said toner cartridge being adapted to mate with each other when said toner cartridge is attached on said toner hopper housing so as to allow discharge of toner therethrough from said toner cartridge into said toner hopper housing;

said toner cartridge having a strip of sealing tape closing said bottom opening, said sealing tape being adapted to be removed away along the length of said bottom opening from one longitudinal end of said bottom opening to the other longitudinal end of said bottom opening to open said bottom opening after said toner cartridge is attached on said toner hopper housing, said longitudinal direction being a direction of removal of said sealing tape;

said toner hopper housing having a plurality of partition walls arranged in the direction of removal of said sealing tape and facing the bottom opening of the toner cartridge and so formed as to divide said space in said toner hopper housing into a plurality of local regions arranged along the length of said toner hopper housing, such that any toner falling down from said toner cartridge into said toner hopper housing upon removal of said sealing tape is substantially prevented from moving from one of said plurality of local regions into another.

2. A toner reservoir according to claim 1, wherein:

each partition wall of said plurality of partition walls comprises a flat vertical wall extending in a vertical plane substantially perpendicular to the longitudinal direction of said toner hopper housing.

3. A toner reservoir according to claim 1, wherein:

each partition wall of said plurality of partition walls comprises a flat vertical wall having a top edge thereof facing to and lying adjacent the under surface of said sealing tape after said toner cartridge is attached on said toner hopper housing and before said sealing tape is removed.

4. A toner reservoir according to claim 1, wherein:

said toner reservoir further comprises a dispenser roller, having an effective length, for dispensing toner from said toner reservoir and housed in said toner hopper housing; and said top opening of said toner hopper housing extending along and just above said dispenser roller so as to substantially cover said effective length of said dispenser roller.

5. A toner reservoir according to claim 4, wherein:

said toner hopper housing has a double-bottom structure comprising an inner bottom wall and an outer bottom wall;

said inner bottom wall is adapted to cooperate with said dispenser roller to control an amount of toner to be dispensed from said toner reservoir; and said outer bottom wall has a toner dispensing slit through which toner is dispensed from said toner reservoir.

6. A toner reservoir according to claim 5, wherein:

said toner reservoir is provided with a toner sensor disposed in said toner hopper housing above and adjacent said inner bottom wall.

7. A toner reservoir according to claim 1, wherein:

a first side edge of each partition wall is connected to a first side wall of the toner hopper housing, while a second side edge of each partition wall faces a second side wall of the toner hopper housing opposite said first side wall, a gap being left between the second side edge of the partition wall and the second side wall of the toner hopper housing.

8. A toner reservoir according to claim 1, wherein:

a bottom edge of each partition wall faces an inner bottom wall of the toner hopper housing, a gap being left between a bottom edge of each partition wall and the inner bottom wall of the toner hopper housing.

9. A toner reservoir for use in an electrostatic image generating apparatus, comprising:

an elongated toner hopper housing extending in a horizontal direction and defining a space for reserving toner therein, said toner hopper housing having an elongated top opening extending in a longitudinal direction of said toner hopper housing;

an elongated toner cartridge having an amount of toner filled therein and adapted for detachable attachment on said toner hopper housing with the bottom thereof on the top of said toner hopper housing, said toner cartridge having an elongated bottom opening extending in a longitudinal direction of said toner cartridge;

said top opening of said toner hopper housing and said bottom opening of said toner cartridge being adapted to mate with each other when said toner cartridge is attached on said toner hopper housing so as to allow discharge of toner therethrough from said toner cartridge into said toner hopper housing;

said toner cartridge having a strip of sealing tape closing said bottom opening, said sealing tape being adapted to be removed away along the length of said bottom opening from one longitudinal end of said bottom opening to the other longitudinal end of said bottom opening to open said bottom opening after said toner cartridge is attached on said toner hopper housing, said longitudinal direction being a direction of removal of said sealing tape;

said toner hopper housing having one or more partition walls so formed as to divide said space in said toner hopper housing into two or more local regions arranged along the length of said toner hopper housing and arranged in the direction of removal of said sealing tape and, such that any toner falling down from said toner cartridge into said toner hopper housing upon removal of said sealing tape is substantially prevented from moving from one of said local regions into another.

10. A toner reservoir for use in an electrostatic image generating apparatus, comprising:

an elongated toner hopper housing extending in a horizontal direction and defining a space for reserving toner therein, said toner hopper housing having an elongated top opening extending longitudinally of said toner hopper housing;

an elongated toner cartridge having an amount of toner filled therein and adapted for detachable attachment on said toner hopper housing with the bottom thereof on the top of said toner hopper housing, said toner cartridge having an elongated bottom opening extending longitudinally of said toner cartridge;

said top opening of said toner hopper housing and said bottom opening of said toner cartridge being adapted to mate with each other when said toner cartridge is attached on said toner hopper housing so as to allow discharge of toner therethrough from said toner cartridge into said toner hopper housing;

said toner cartridge having a strip of sealing tape closing said bottom opening, said sealing tape being adapted to be removed away to open said bottom opening after said toner cartridge is attached on said toner hopper housing;

said toner hopper housing having one or more partition walls so formed as to divide said space in said toner hopper housing into two or more local regions arranged along the length of said toner hopper housing, such that any toner falling down from said toner cartridge into said toner hopper housing upon removal of said sealing tape is substantially prevented from moving from one of said local regions into another, wherein:

said toner hopper housing has a double-bottom structure comprising an inner bottom wall and an outer bottom wall; said inner bottom wall is adapted to cooperate with said dispenser roller to control amount of toner to be dispensed from said toner reservoir; and said outer bottom wall has a toner dispensing slit through which toner is dispensed from said toner reservoir.

11. A toner reservoir according to claim 10, wherein:

said toner reservoir is provided with a toner sensor disposed in said toner hopper housing above and adjacent said inner bottom wall.

12. A toner reservoir for use in an electrostatic image generating apparatus, comprising:

an elongated toner hopper housing extending in a horizontal direction and defining a space for reserving toner therein, said toner hopper housing having an elongated top opening extending longitudinally of said toner hopper housing;

an elongated toner cartridge having an amount of toner filled therein and adapted for detachable attachment on said toner hopper housing with the bottom thereof on the top of said toner hopper housing, said toner cartridge having an elongated bottom opening extending longitudinally in a longitudinal direction of said toner cartridge;

said top opening of said toner hopper housing and said bottom opening of said toner cartridge being adapted to mate with each other when said toner cartridge is attached on said toner hopper housing so as to allow discharge of toner therethrough from said toner cartridge into said toner hopper housing;

said toner cartridge having a strip of sealing tape closing said bottom opening, said sealing tape being adapted to be removed away to open said bottom opening after said toner cartridge is attached on said toner hopper housing;

said toner hopper housing having one or more partition walls so formed as to divide said space in said toner hopper housing into two or more local regions arranged along the length of said toner hopper housing, such that any toner falling down from said toner cartridge into said toner hopper housing upon removal of said sealing tape is substantially prevented from moving from one of said local regions into another, wherein said toner hopper housing includes an inner bottom wall adapted to cooperate with said dispenser roller to control an amount of toner to be dispensed from said toner reservoir; and said toner reservoir is provided with a toner sensor disposed in said toner hopper housing above and adjacent said inner bottom wall.

* * * * *